US006953118B2

(12) United States Patent
Seno et al.

(10) Patent No.: US 6,953,118 B2
(45) Date of Patent: Oct. 11, 2005

(54) CONTAINER FOR SHIPPING AND DISPLAY

(75) Inventors: Atsuo Seno, Chiba (JP); Satoru Saito, Chiba (JP)

(73) Assignee: Uniden Corporation, Tokyo (JP)

( * ) Notice: Subject to any disclaimer, the term of this patent is extended or adjusted under 35 U.S.C. 154(b) by 188 days.

(21) Appl. No.: 10/404,487

(22) Filed: Apr. 1, 2003

(65) Prior Publication Data

US 2004/0195148 A1 Oct. 7, 2004

(51) Int. Cl.[7] ..... B65D 5/50

(52) U.S. Cl. ..... 206/764; 206/485; 206/526; 206/765

(58) Field of Search ..... 206/736, 751, 206/752, 756, 764, 765, 774, 45.28, 45.29, 45.3, 461, 470, 471, 485, 486, 526

(56) References Cited

U.S. PATENT DOCUMENTS 3,009,622 A * 11/1961 Leone ..... 206/485
3,123,207 A 3/1964 Goldstein
3,133,632 A 5/1964 Goldstein
3,152,687 A 10/1964 Goldstein
3,167,179 A 1/1965 Goldstein
3,351,182 A 11/1967 Greer et al.
3,565,322 A 2/1971 Cerf
3,927,761 A * 12/1975 Boyle ..... 206/756
4,116,330 A 9/1978 Ellis
4,485,922 A * 12/1984 Desmond et al. ..... 206/485
4,936,450 A 6/1990 Paul
5,145,060 A 9/1992 Maye
5,251,753 A 10/1993 Pigott et al.
D353,092 S 12/1994 Green
5,464,091 A * 11/1995 Callahan et al. ..... 206/485
5,485,918 A * 1/1996 Lasenby et al. ..... 206/485
5,921,398 A 7/1999 Carroll
D412,631 S 8/1999 Green
5,979,662 A 11/1999 Green
6,050,420 A 4/2000 Green
6,135,289 A * 10/2000 Miller ..... 206/774
6,152,305 A 11/2000 Green
6,367,632 B1 4/2002 Green
6,427,842 B1 8/2002 Green
6,431,363 B1 * 8/2002 Hacker ..... 206/765
6,435,351 B1 8/2002 Gibb
6,454,107 B1 9/2002 Belanger et al.

* cited by examiner

*Primary Examiner*—Luan K. Bui
(74) *Attorney, Agent, or Firm*—Sidley Austin Brown & Wood LLP

(57) ABSTRACT

A container, convertible from a shipping configuration to a displaying configuration, includes a shipping cover and a shipping liner fitted inside the shipping cover. The shipping liner defines a plurality of slots for laterally supporting display packs. The container also includes a display base, which also serves as a lid that fits on the shipping cover after the shipping liner and display packs have been packed therein in the shipping configuration. To convert from the shipping configuration to the displaying configuration, the container is positioned with the display base on bottom, and the shipping cover is lifted from the display base, leaving the display packs neatly in the display base and the shipping liner fixed in the shipping cover.

18 Claims, 13 Drawing Sheets

CONTAINER FOR SHIPPING AND DISPLAY

FIELD OF THE INVENTION

The present invention relates to a container configured to hold a set of articles or goods by which said articles or goods can be arranged, protected, and displayed in a particular manner to facilitate transportation, storage, and sale of said articles or goods. More specifically, the present invention relates to a container that is convertible from a shipping configuration to a display configuration and vice-versa.

BACKGROUND

It is well known, particularly among those skilled in the art of merchandising, that manufacturers often provide retailers with various types of point-of-purchase displays. The point-of-purchase displays are usually designed to attractively and strategically display a product. However, sometimes the point-of-purchase displays are cumbersome and time-consuming to assemble. As a result, a number of displays and/or products are damaged due to incorrect display assembly. Other times, assembly of more complex point-of-purchase displays is delayed or even dispensed with at the retail level for various reasons such as time constraints on the retailer's employees.

In view of such problems, efforts have been made in the past to fashion point-of-purchase displays that are relatively simpler for employees at the retail level to assemble. One example is set forth in U.S. Pat. No. 5,979,662 to Green and shown herein as FIG. 1. The prior art shown in FIG. 1 is a packaging assembly 100 that includes a display stand 110, a plurality of display packs 120, and a shipping cover 130. Each display pack 120 is configured to contain one or more packaged products 140 for both shipping and display. The display stand 110 includes left and right sides 150L and 150R that extend parallel to each other. Each of the left and right sides 150L and 150R include a plurality of slots 160. As shown in FIG. 1, slots 160 in the left side 150L are generally aligned with respective slots 160 in the right side 150R. Each of the display packs 120 is provided with a peripheral flange 170, portions of which can be inserted into a respective pair of opposing slots 160 so that the pair of slots 160 provides support for the display pack 120.

The packaging assembly 100 shown in FIG. 1 is shipped to retailers with the display packs 120 packed in the display stand 110 such that portions of the peripheral flange 170 of each display pack 120 are inserted into respective opposing slots 160, and the combination of the display stand 110 and the packed display packs 120 packed into a cavity defined by the inside of the shipping cover 130. This way, when the packaging assembly 100 arrives at the various retailers and the shipping cover 130 is removed, the combination of the display stand 110 and the display packs 120 can serve as a point-of-purchase display.

However, despite the relatively short amount of time required for transforming the packaging assembly 100 from a shipping container to a product display, there are still several disadvantages associated with such an assembly. For example, often product displays such as the combination of the display stand 110 and the display packs 120 initially have a neat and orderly appearance only to quickly become disarrayed once exposed to consumers. Many consumers browse, removing products such as the display packs 120 from displays such as the display stand 110, briefly view the contents or packaging of the products, then return the products to the displays without taking the time to do things such as align flanges with slots. Instead, the products will be left in a manner that is easy for the consumer, such as stacked or leaning on one another. Other times, displays are damaged when consumers attempt such things as forcing a misaligned product back into a display. For example, attempting to force a misaligned display pack 120 can permanently damage slots 160 and/or sides 150 of the display stand 110. Furthermore, in any situation where the display stand 110 happens to become damaged, the peripheral flange 170 of the display packs 120 makes it difficult for a retailer to easily find an alternate location, such as a counter top or a surface of a shelf, for displaying the products.

SUMMARY OF THE INVENTION

In view of the various shortcomings associated with the prior art, an object of the present invention is to provide a shipping container that can be readily converted into an attractive and effective product display.

Another object of the present invention is to provide a container that is readily convertible between a shipping configuration and a display configuration.

A further object of the present invention is to provide a product shipping container that is relatively simple to convert into a product display, wherein the product display presents the product in a neat and orderly manner that is relatively easy for consumers to maintain, and wherein the product display is relatively less prone to damage due to incorrect placement of products.

A packaging assembly including aspects of the invention disclosed herein comprises a base having a generally flat base surface and a peripheral base wall around the base surface, where the base wall includes a base back wall, opposite base side walls, and a base front wall, which together are configured to laterally retain a plurality of display packs on the base surface. The packaging assembly also includes a shipping cover having a generally flat cover surface and a peripheral cover wall around the cover surface, where the peripheral cover wall includes a cover back wall, opposite cover side walls, and a cover front wall. The shipping cover and the base are designed to be removably securable with one another. The packaging assembly further includes a shipping liner having a liner surface, extending in a first direction and in a second direction, that defines slots for restraining display packs in at least one of said first and second directions.

While the display packs are restrained by the liner slots in at least one of said first and second directions, the display packs are unrestrained by the slots in a direction normal to the liner surface. For example, if the liner is fixed in the shipping cover and the display packs are seated in their respective slots, and the shipping cover is appropriately inverted, the display packs are free to move under the force of gravity unrestrained by the slots.

However, the shipping liner is preferably fixed or removably fixed in the shipping cover so that, while the display packs are free to move from a space defined by the shipping cover, the shipping liner remains in the space defined by the shipping cover. For example, the shipping liner can include two outwardly projecting locking tongues, and the opposite cover side walls can each include a slit which is sized and configured to receive therewithin a respective one of the locking tongues, whereby the shipping liner may be retained in the shipping cover. Alternatively, the shipping liner may simply be glued into the shipping cover.

In order to provide a view of the contents of the packaging assembly, at least one of the walls of the display cover and/or of the shipping cover can define a gap suitable for viewing at least a portion of at least one of the display packs. Preferably, front and back walls of both the display and shipping covers include such gaps, and the gaps are configured such that the extent of each of the gaps are aligned with one another when the shipping cover is removably engaged with the base.

With regard to the slots, in one embodiment the shipping liner includes opposing liner side walls, each of which extends somewhat normal to the liner surface from opposite edges thereof. Each of these liner side walls extends interiorly about a respective one of the cover side walls. Each of these liner side walls also defines a plurality of slots, including the slot mentioned above. Each slot defined by one of the liner side walls corresponds with a slot defined by the other liner side walls to form a corresponding pair of slots. Each corresponding pair of slots is configured to receive one of the display packs.

In this embodiment, portions of the shipping liner adjoining each side of each of the slots are spaced from the respective cover side wall to define a plurality of retaining gaps. Each of the plurality of retaining gaps cooperates with an adjacent retaining gap to form a corresponding pair of retaining gaps. Further, each pair of corresponding retaining gaps cooperates with another pair of corresponding retaining gaps to form a corresponding quadruplet of retaining gaps. Finally, each corresponding quadruplet of retaining gaps is configured to receive flanged portions of one of the display packs. The display packs are unrestrained by the gaps in the direction normal to the liner surface.

In another embodiment, the liner surface defines the plurality of slots. Here, at least a portion of the liner surface is spaced from the cover surface. Each slot is configured to receive therewithin a portion of a respective one of said display packs.

According to another aspect of the invention, a method of packing a plurality of products for shipping and display is presented comprising the steps of positioning a shipping liner in a shipping cover, the shipping cover having a generally flat cover surface and a peripheral cover wall around the cover surface, said peripheral cover wall including a cover back wall, opposite cover side walls, and a cover front wall, wherein the shipping liner includes two outwardly projecting locking tongues, and wherein each of the opposite cover side walls includes a slit which is sized and configured to receive therewithin a respective one of said locking tongues, whereby the shipping liner may be retained in the shipping cover; seating a display pack that houses at least one of the plurality of products in a slot provided in the shipping liner, wherein the shipping liner has a liner surface that extends in a first direction and in a second direction, and the shipping liner defines the slot, said slot being suitable for restraining a portion of the display pack in at least one of said first and second directions; and positioning a base onto the shipping cover, the base having a generally flat base surface and a peripheral base wall around the base surface, said base wall including a base back wall, opposite base side walls, and a base front wall, which together are configured to laterally retain the plurality of display packs on the base surface, the base being configured to be removably engaged with the shipping cover.

According to a further aspect of the invention, a method of packing a plurality of display packs for shipping and display is presented comprising the steps of forming a base from a blank, the base having a generally flat base surface and a peripheral base wall around the base surface, said base wall including a base back wall, opposite base side walls, and a base front wall, which together are configured to laterally retain the plurality of display packs on the base surface; forming a shipping cover from a blank, the shipping cover having a generally flat cover surface and a peripheral cover wall around the cover surface, said peripheral cover wall including a cover back wall, opposite cover side walls, and a cover front wall, the shipping cover being configured to be removably engaged with the base; forming a shipping liner from a blank, the shipping liner having a liner surface that extends in a first direction and in a second direction, the shipping liner defining a plurality of slots, each slot for restraining at least a portion of a respective one of the plurality of display packs in at least one of said first and second directions, wherein the shipping liner includes a plurality of outwardly projecting locking tongues, and wherein each of the opposite cover side walls includes a slit which is sized and configured to receive therewithin a respective one of said locking tongues; positioning the shipping liner in the shipping cover such that the shipping liner is retained within the shipping cover; and seating the plurality of display packs in respective slots in the shipping liner.

According to yet another aspect of the invention, a kit for a convertible packaging assembly is provided that comprises a plurality of display packs, where each display pack is suitable for encasing merchandise; a blank for forming a base, the base having a generally flat base surface and a peripheral base wall around the base surface, said base wall including a base back wall, opposite base side walls, and a base front wall, which together are configured to laterally retain the plurality of display packs on the base surface; a blank for forming a shipping cover, the shipping cover having a generally flat cover surface and a peripheral cover wall around the cover surface, said peripheral cover wall including a cover back wall, opposite cover side walls, and a cover front wall, the shipping cover being configured to be removably engaged with the base; and a blank for forming a shipping liner, the shipping liner having a liner surface that extends in a first direction and in a second direction, the shipping liner defining a plurality of slots, each slot for restraining at least a portion of a respective one of the plurality of display packs in at least one of said first and second directions.

BRIEF DESCRIPTION OF THE DRAWINGS

Several embodiments of the present invention will now be described by way of example only, with reference to the accompanying drawings in which:

FIGS. 6*a*–6*c* are views for illustrating the seating of a display pack in a shipping liner, wherein FIG. 6*a* is an exploded perspective view, FIG. 6*b* is a frontal plan view, and FIG. 6*c* is a perspective view;

DETAILED DESCRIPTION OF THE DRAWINGS

Figure 1:
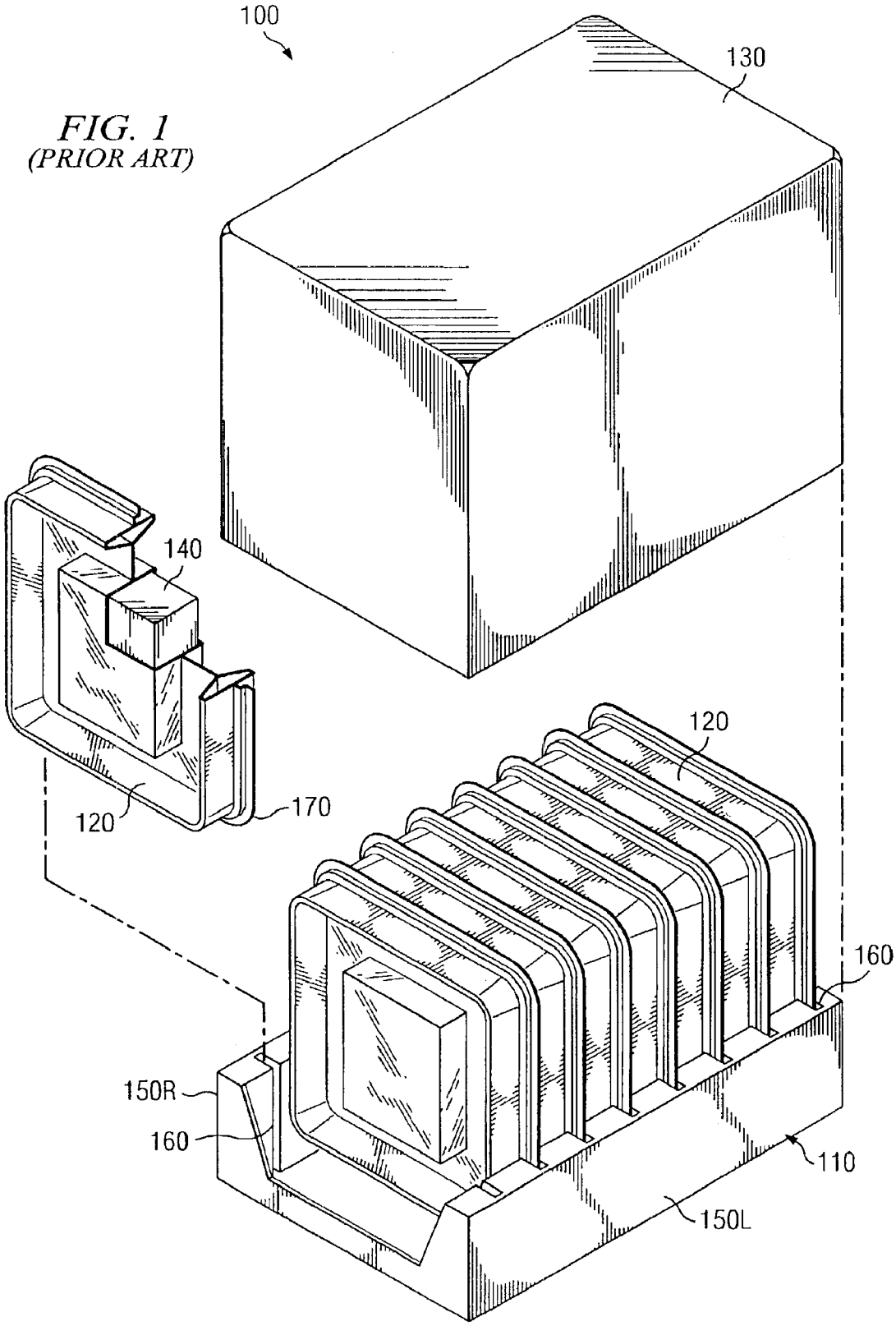
FIG. 1 (PRIOR ART)
FIG. 1 is an exploded perspective view of a prior art packaging assembly.
Figure 2A:
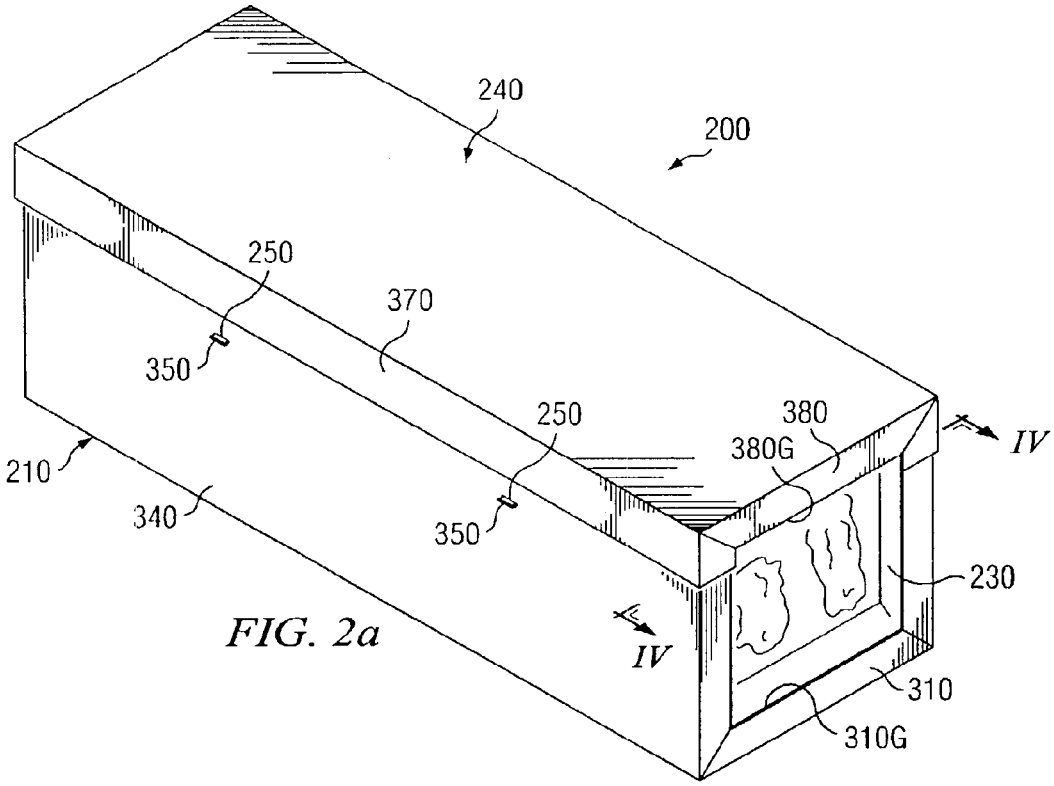
FIGS. 2*a* and 2*b* are perspective views of shipping and displaying configurations, respectively, of a convertible packaging assembly in accordance with a first embodiment of the invention.
Figure 2B:
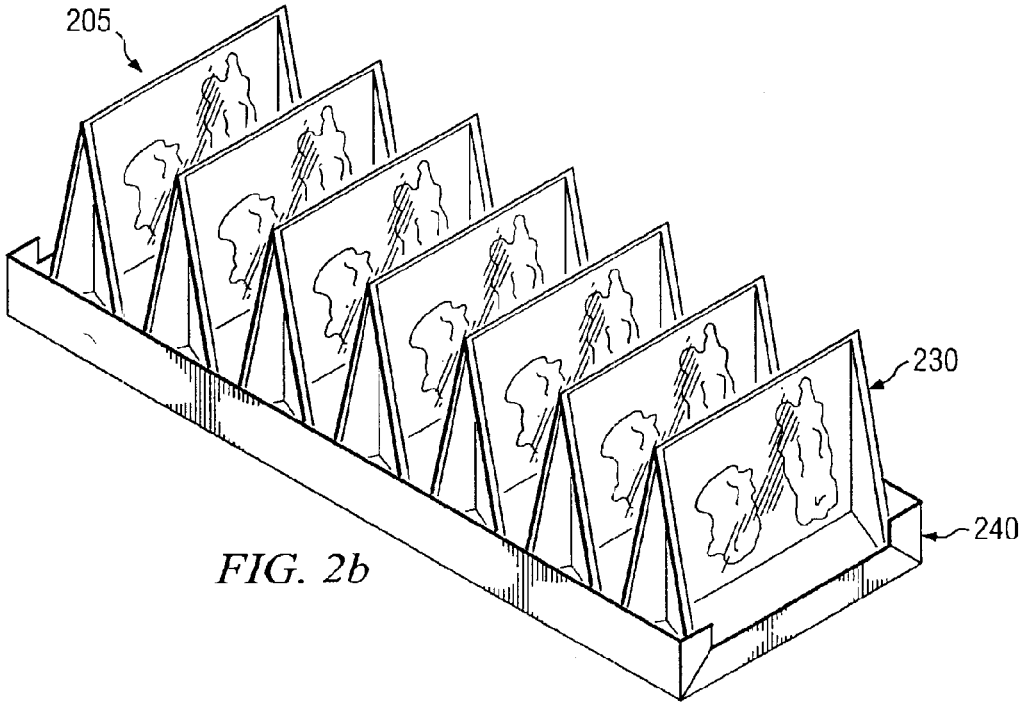
Figure 3:
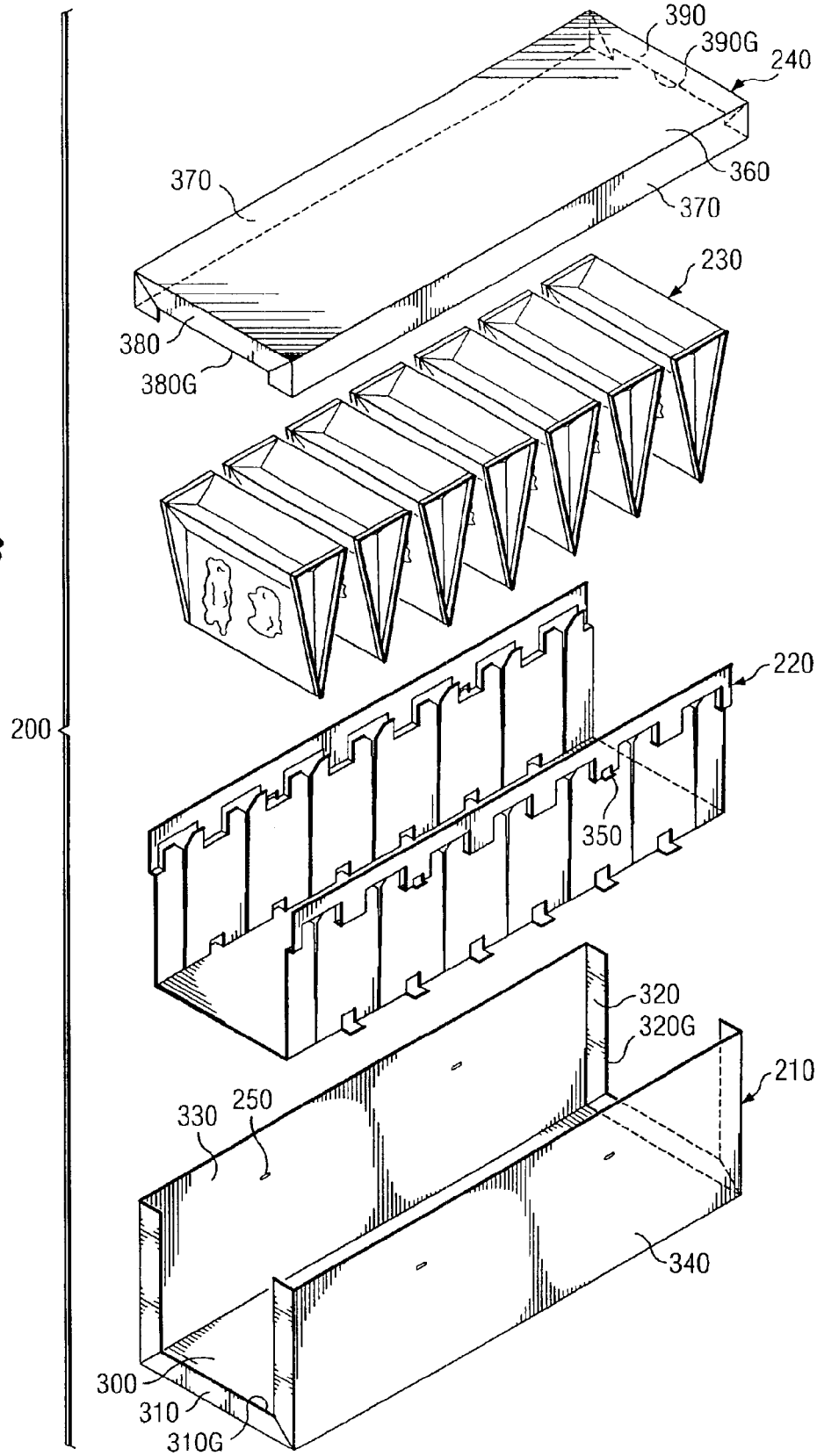
FIG. 3 is an exploded view of the convertible packaging assembly in the shipping configuration shown in FIG. 2*a;*

FIG. 2*a* shows a convertible packaging assembly 200 in accordance with a first embodiment of the invention. The convertible packaging assembly 200 is shown in FIG. 2*a* in a shipping configuration. Alternately, FIG. 2*b* shows a display unit 205, which is the convertible packaging assembly 200 transformed from the shipping configuration to a displaying configuration. As shown in FIG. 3, the convertible packaging assembly 200 includes a shipping shell 210 which acts as a shipping cover, a shipping liner 220, a plurality of display packs 230, and a display shell 240. In the shipping configuration, as shown in FIG. 2*a*, the shipping shell 210, shipping liner 220, and display shell 240 are used together for shipping products packaged in each of the plurality of display packs 230. In the displaying configuration, as shown in FIG. 2*b*, the display shell 240 is used as a base for displaying the products packaged in each of the plurality of display packs 230. Also shown in FIG. 2*a* is a pair of retaining holes 250 in a side of the shipping shell 210. The retaining holes 250 are used for retaining the shipping liner 220 in the shipping shell 210, as will be discussed in greater detail below.

The present embodiment of the shipping shell 210, shipping liner 220, and display shell 240 are constructed of corrugated fiberboard. However, other materials for construction of one or more of the shipping shell 210, the shipping liner 220, and the display shell 240 are similarly contemplated. For example, it is contemplated that any of a variety of types of materials, individually or in combination, including fiberboard, paperboard, plastic, metal, and wood could also be used as construction materials for one or more of the shipping shell 210, the shipping liner 220, and the display shell 240.

FIG. 3 shows an exploded view of the shipping configuration of the packaging assembly 200. Pursuant to the first embodiment, the shipping shell 210 is provided having a generally flat cover surface 300. The shipping shell 210 also has a cover front wall 310 that defines a front cover gap 310G, a cover back wall 320 that defines a back cover gap 320G, and opposite cover side walls 330 and 340. The combination of the cover surface 300, the cover front wall 310, the cover back wall 320, and the opposite cover side walls 330 and 340 at least partially define a space into which the shipping liner 220 and the plurality of display packs 230 can be packed for shipping. Similarly, the display shell 240 is provided having a generally flat display surface 360 suitable for supporting the plurality of display packs 230 as shown in FIG. 2*b*. The display shell 240 also has a pair of opposing display side walls 370, a display front wall 380 that defines a front display gap 380G, and a display back wall 390 that defines a back display gap 390G. The display shell 240 is configured to fit onto the shipping shell 210 as a lid or the like as shown in FIG. 2*a*. Preferably, the front and back cover gaps 310G and 320G and the front and back display gaps 380G and 390G are defined such that, when the packaging assembly 200 is in the shipping configuration shown in FIG. 2*a*, the front and back cover gaps 310G and 320G are aligned with the front and back display gaps 380G and 390G, respectively.

Figure 4:
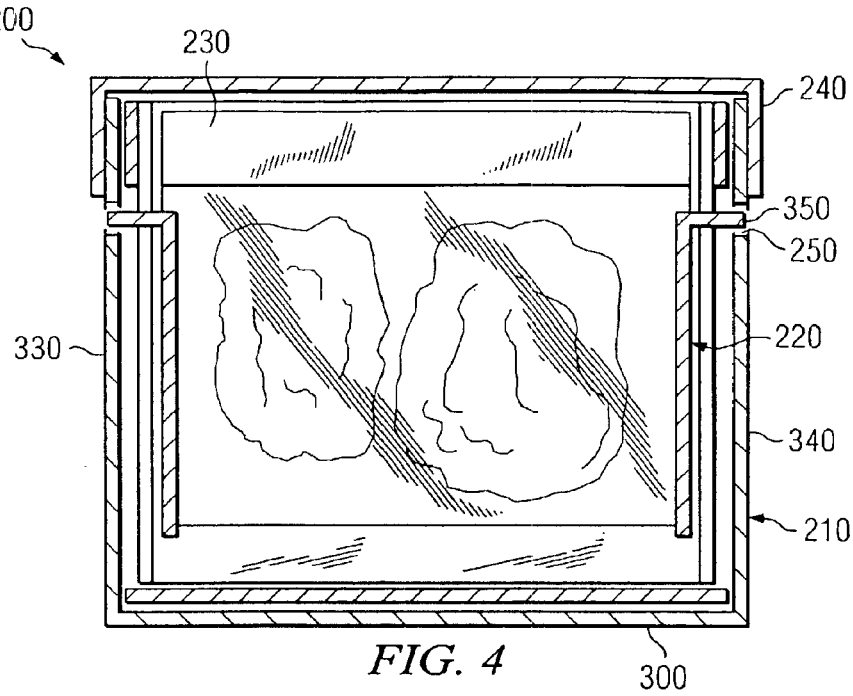
FIG. 4 is a cross-sectional view taken along lines IV—IV of the convertible packaging assembly shown in FIG. 2*a;*

First, the positioning of the shipping liner 220 in the shipping shell 210 will be discussed with reference to FIGS. 3 and 4. FIG. 4 is a cross-sectional view taken along lines IV—IV of the convertible packaging assembly 200 shown in FIG. 2*a*. The shipping liner 220 is configured to line the interior side of the cover side walls 330 and 340 and the cover surface 300. The shipping liner 220 has a plurality of outwardly projecting retaining tongues 350. When the shipping liner 220 is properly positioned in the shipping shell 210, each of the plurality of retaining tongues 350 will engage a respective retaining hole 250, resulting in the shipping liner 220 being retained in the shipping shell 210. The purpose of the shipping liner 220 will be better understood when discussed below with regard to packing the display packs 230 for shipping.

Figure 5A:
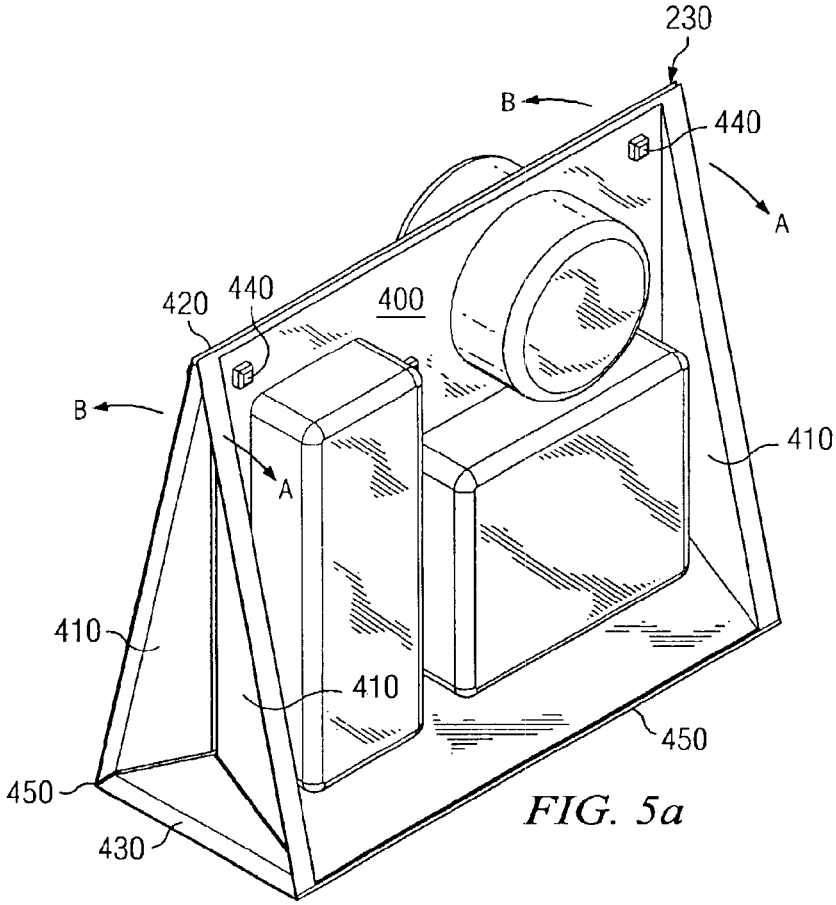
FIGS. 5*a* and 5*b* are perspective views of a closed display pack and an open display pack, respectively.
Figure 5B:
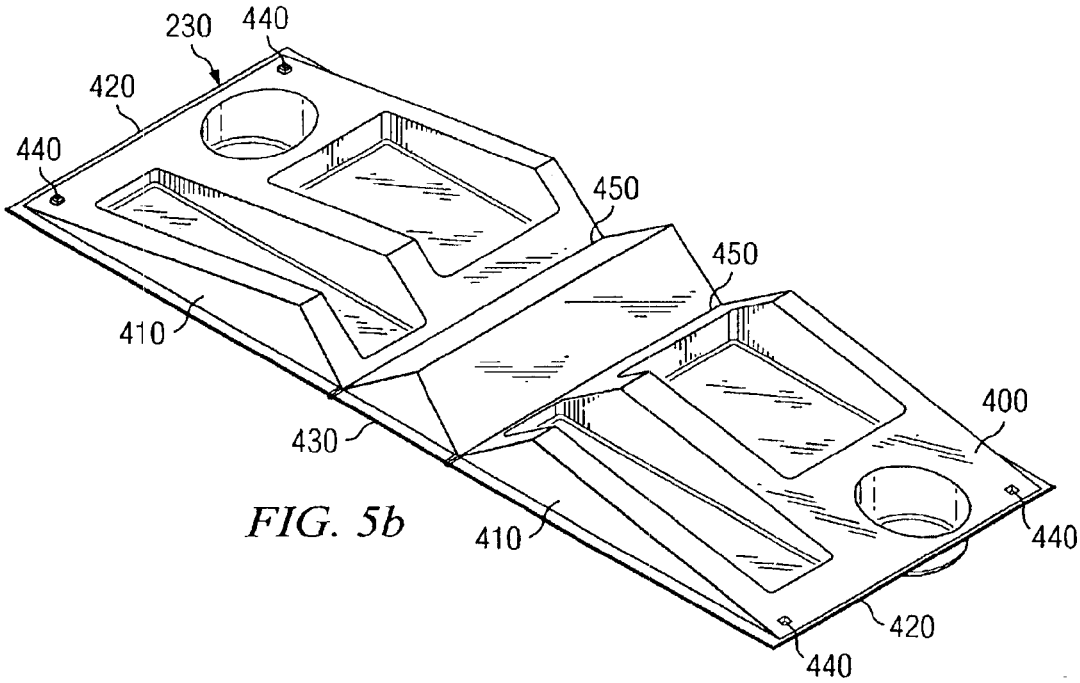

FIGS. 5*a* and 5*b* show a perspective view of one of the plurality of display packs 230. As shown in FIG. 5*a*, the display pack 230 has a central portion 400 and a pair of flanged portions 410 on each end of the central portion 400. Each of the flanged portions 410 tapers from a ridge 420 to a base 430 such that each pair of flanged portions 410 has a generally triangular shape. The central portion 400 includes provisions for storing a product or products to be shipped and displayed. For example, in the present embodiment the surface of the central portion 400 is formed to define sufficient space within the display pack 230 for storing the product(s). Naturally, there are numerous volumes and shapes that could be desirable within the central portion 400 since the display pack 230 is not limited to use with any particular product. For this reason, the surface of the central portion 400 is in no way intended to be limited to that shown in FIG. 5*a*.

The space within the display pack 230 can be accessed by unfastening fasteners 440 and moving opposing sides of the display pack 230 about respective hinges 450 as indicated by arrows A and B in FIG. 5*a* in order to open the display pack 230 as shown in FIG. 5*b*. This process is simply reversed if, for example, products have been packed in the display pack 230 shown in FIG. 2*b* and one wishes to close the display pack as shown in FIG. 5*a*. It should be noted that the fasteners 440 are intended to be representative of a variety of ways that the display pack 230 could be secured, in any of a variety of degrees of permanence, in the closed arrangement as shown in FIG. 5*a*. For example, it is contemplated that the display pack 230 could be secured closed using, alone or in any combination, adhesive, shrink wrap, heat seal, tape, friction, and/or one or more fasteners of some kind.

Figure 6A:
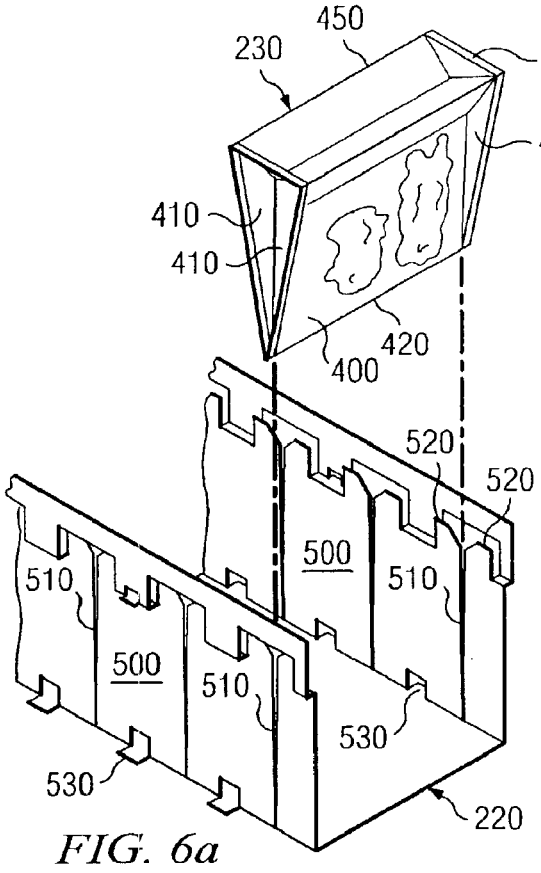
Figure 6C:
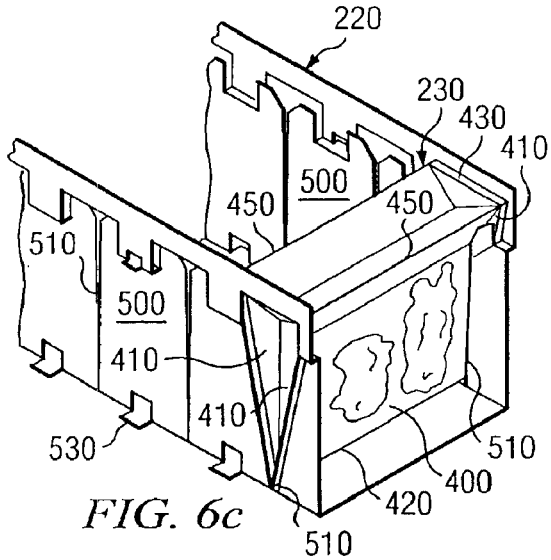
Figure 6B:
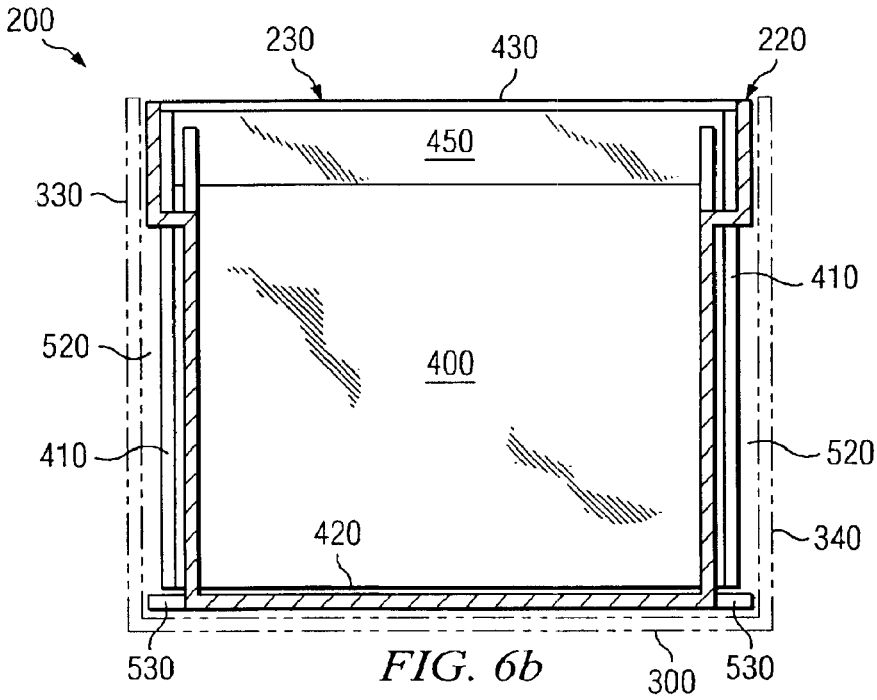

Turning now to FIGS. 6*a*–6*c*, the positioning of the display pack 230 relative to the shipping liner 220 for the shipping configuration will be explained. As shown in FIG. 6*a*, the shipping liner 220 includes a pair of opposing liner side walls 500 that each define a plurality of slots 510. Corresponding pairs of slots 510, one in each of the opposing liner side walls 500, are provided opposite each other for receiving respective ends of the central portion 400 of the display pack 230 as shown by the lines in phantom. As the display pack 230 is inserted, the flanged portions 410 are each trapped in a respective retaining gap 520 between the shipping liner 220 and the shipping shell 210. The retaining gaps 520 can be also be seen in FIG. 6*b*, which shows a front view of the display pack 230 inserted into the shipping liner 220. The broken line in FIG. 6*b* shows where the cover surface 300 and cover side walls 330 and 340 would normally be in relation to the shipping liner 220 while in the shipping configuration shown in FIG. 2*a*. FIG. 6*c* shows a perspective view of the display pack 230 inserted into the shipping liner 220.

Also of note are the tabs 530 shown in FIGS. 6*a*–6*c*. As best shown in FIG. 6*a*, the shipping liner 220 includes a plurality of tabs 530, with each of the tabs 530 being provided between a respective pair of slots 510 along both of the liner side walls 500. As shown in FIG. 6*b*, the tabs 530 are configured to somewhat span the respective retaining gaps 520. Thus, the tabs 530 assist in preventing lateral shifting of the shipping liner 220 relative to the shipping shell 210, for example, during rough handling while the packaging assembly 200 is being shipped.

Figure 7:
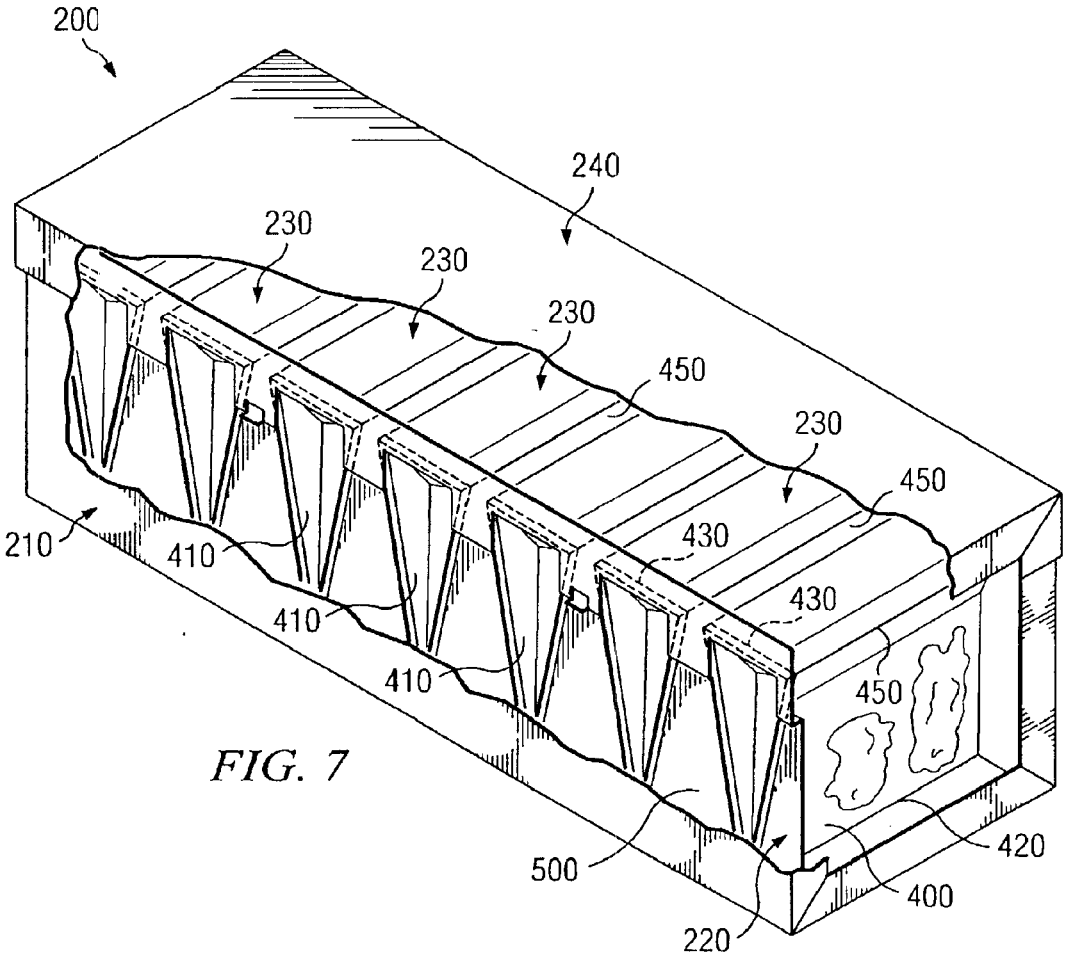
FIG. 7 is a partially broken away perspective view of the convertible packaging assembly in the shipping configuration shown in FIG. 2*a;*

FIG. 7 shows a partially broken away perspective view of the packaging assembly 200 in the shipping configuration. The broken away portions of the shipping shell 210 and the display shell 240 provide a view of the shipping liner 220 and several of the display packs 230. As shown in FIG. 7 and appreciated by the above discussion, the display packs 230 are held securely in place, being prevented from moving longitudinally due at least in part to each of the central portions 400 being held by respective pairs of slots 510, and being prevented from moving laterally due at least in part to each of the flanged portions 410 being positioned in a respective retaining gap 520.

Figure 8A:
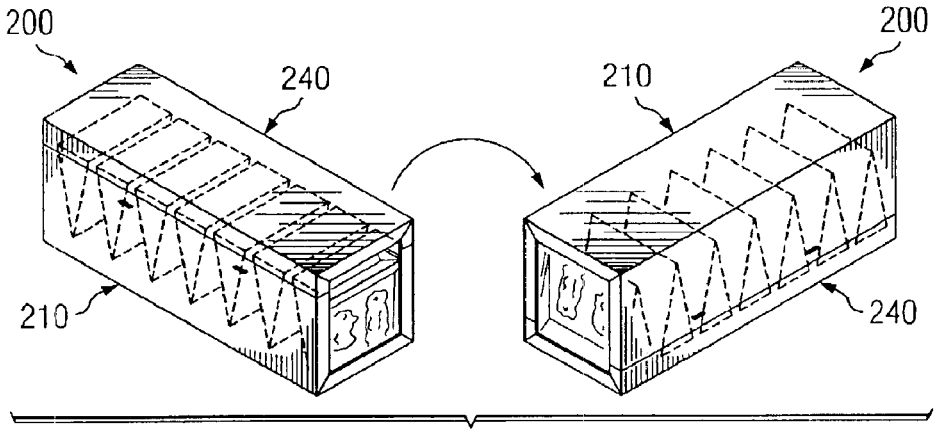
FIGS. 8*a* and 8*b* are perspective views for illustrating the process of transforming the convertible packaging assembly from the shipping configuration to the displaying configuration.
Figure 8B:
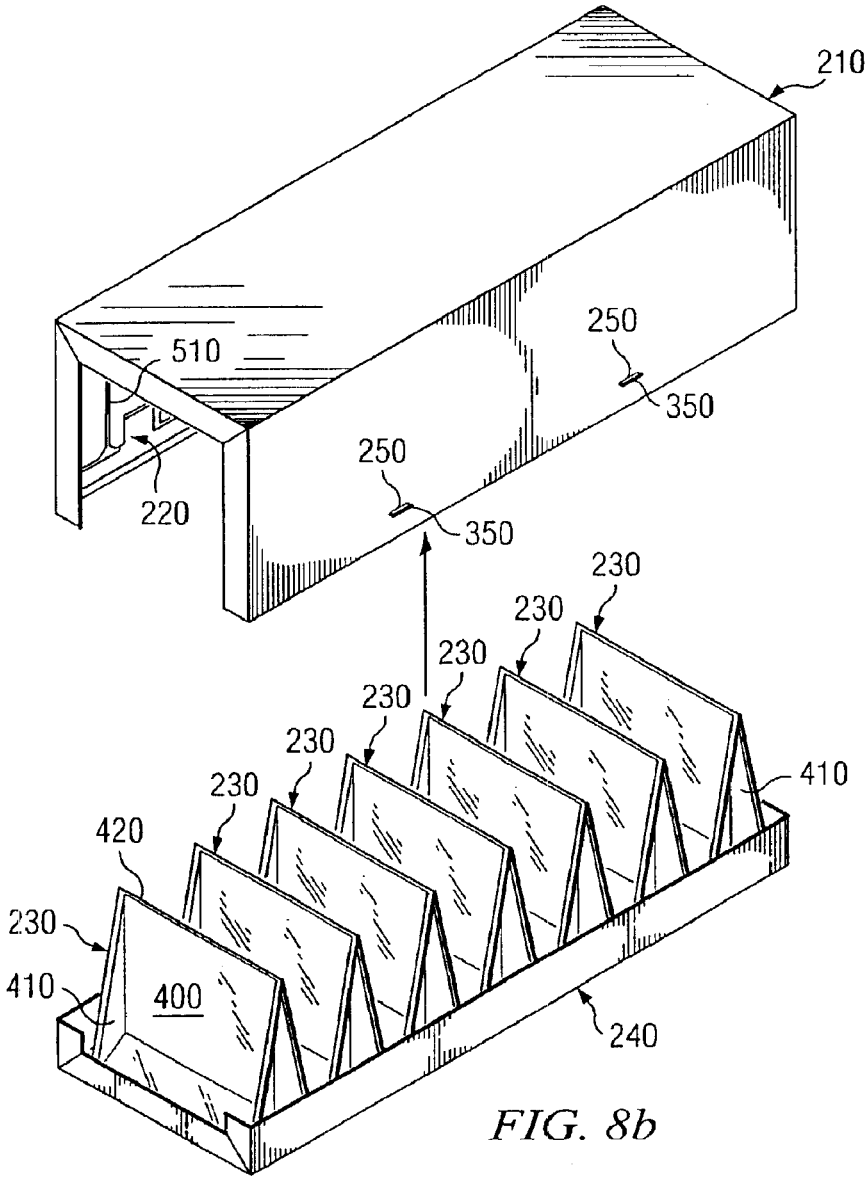

Referring to FIGS. 8*a* and 8*b*, the transformation of the packaging assembly 200 from the shipping configuration shown in FIG. 2*a* to the displaying configuration shown in FIG. 2*b* will be described. As shown in FIG. 8*a*, the packaging assembly 200 is rotated, if not already correctly positioned, so that the display shell 240 is on the bottom and the shipping shell 210 is on the top. Then, as shown in FIG. 8*b*, the shipping shell 210 is lifted off of the display shell 240. As the shipping shell 210 is lifted from the display shell 240, the shipping liner 220 remains somewhat fixed in position relative to the shipping shell 210 and is therefore lifted as well by virtue of the locking tongues 350 and retaining holes 250 discussed above with reference to FIG. 4. However, the display packs 230 remain in the display shell 240 as the shipping shell 210 is lifted, freely sliding from the respective slots 510 and retaining gaps 520. The display packs 230 form a column on the display surface 360 of the display shell 240, with products properly aligned for display to retail customers without the need for physical rearranging of the products or the display packs 230 from a storage container or a shipping container to a display shelf. Thus, by simply lifting the shipping shell 210 from the display shell 240, the packaging assembly 200 can be converted from a shipping configuration to a displaying configuration.

Figure 9B:
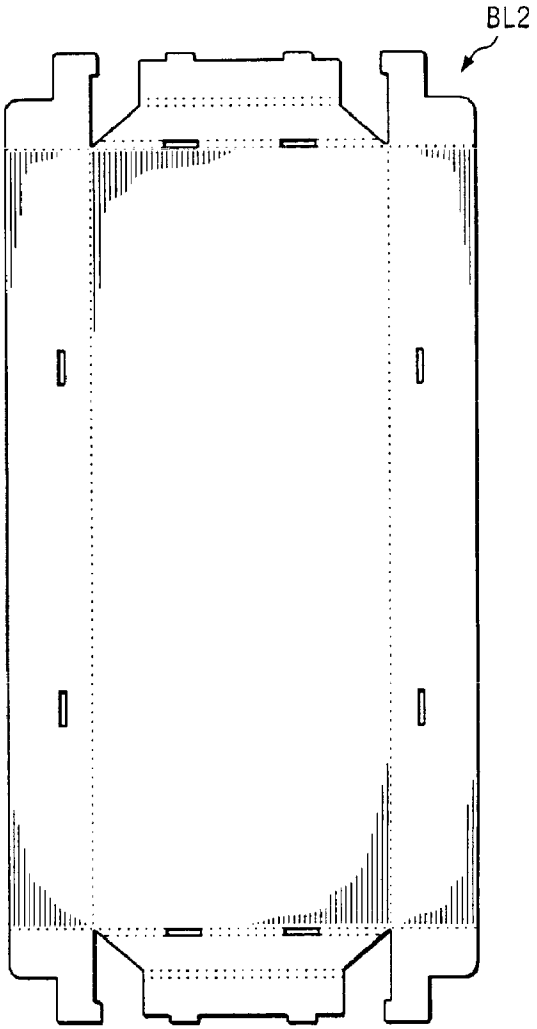
FIGS. 9*a*–9*c* are plan views of blanks suitable for making the shipping shell, the display shell, and the shipping liner, respectively, according to the first embodiment.
Figure 9A:
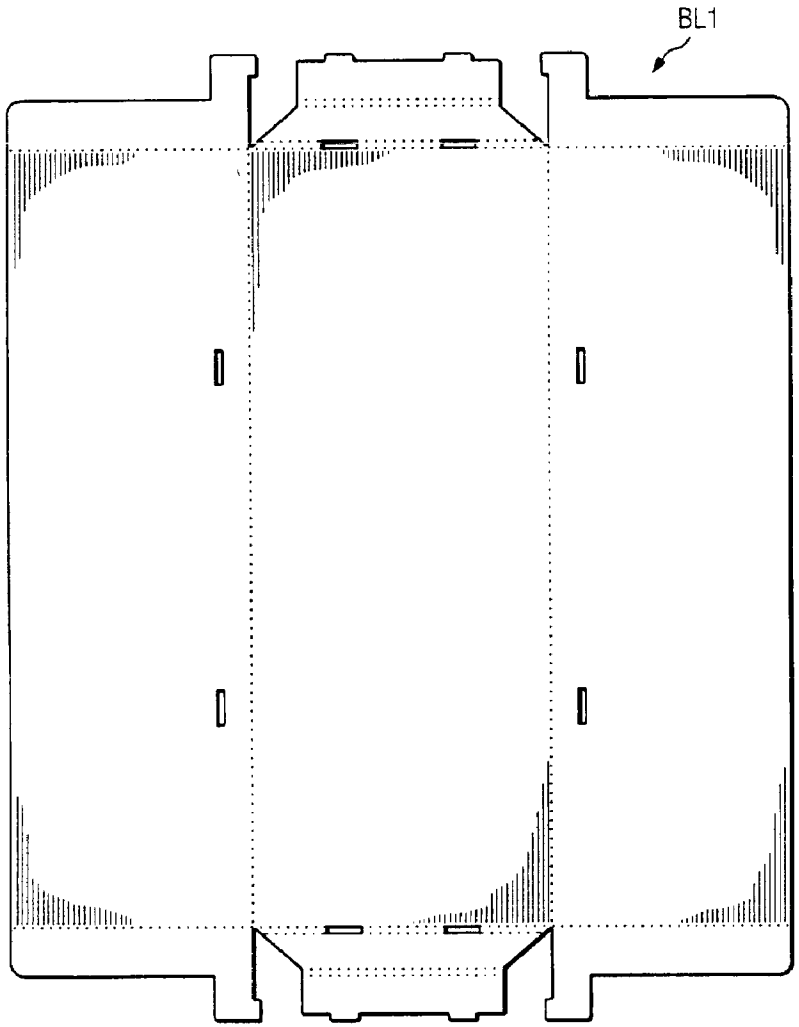
Figure 9C:
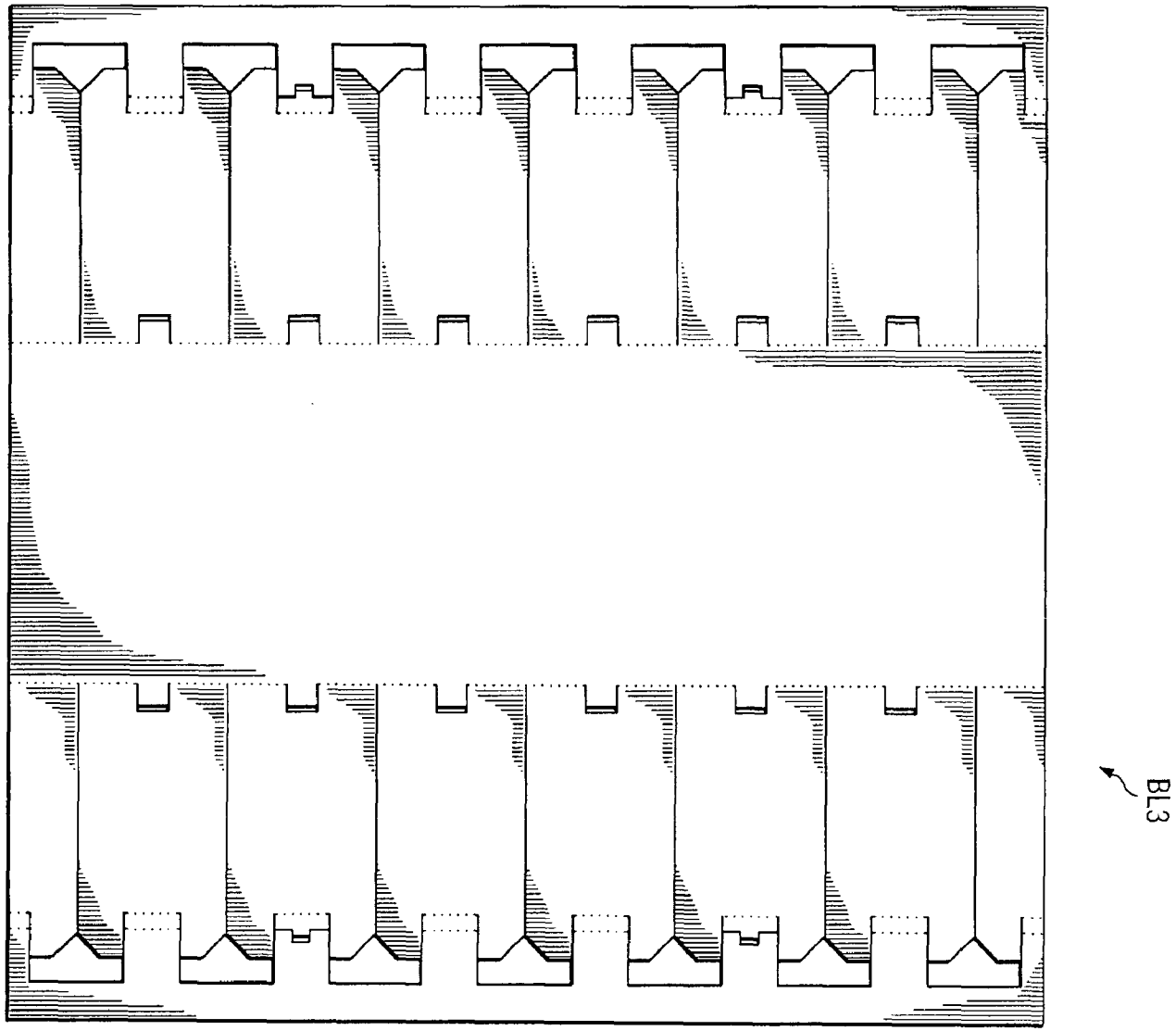

A blank BL1 suitable for making the shipping shell 210 is shown in FIG. 9*a*, a blank BL2 suitable for making the display shell 240 is shown in FIG. 9*b*, and a blank BL3 suitable for making the shipping liner 220 is shown in FIG. 9*c*. In FIGS. 9*a*–9*c*, the solid lines represent cutting lines and the broken lines represent folding lines. Blanks BL1, BL2, and BL3 are each preferably die cut from a respective unitary sheet of material.

Figure 10:
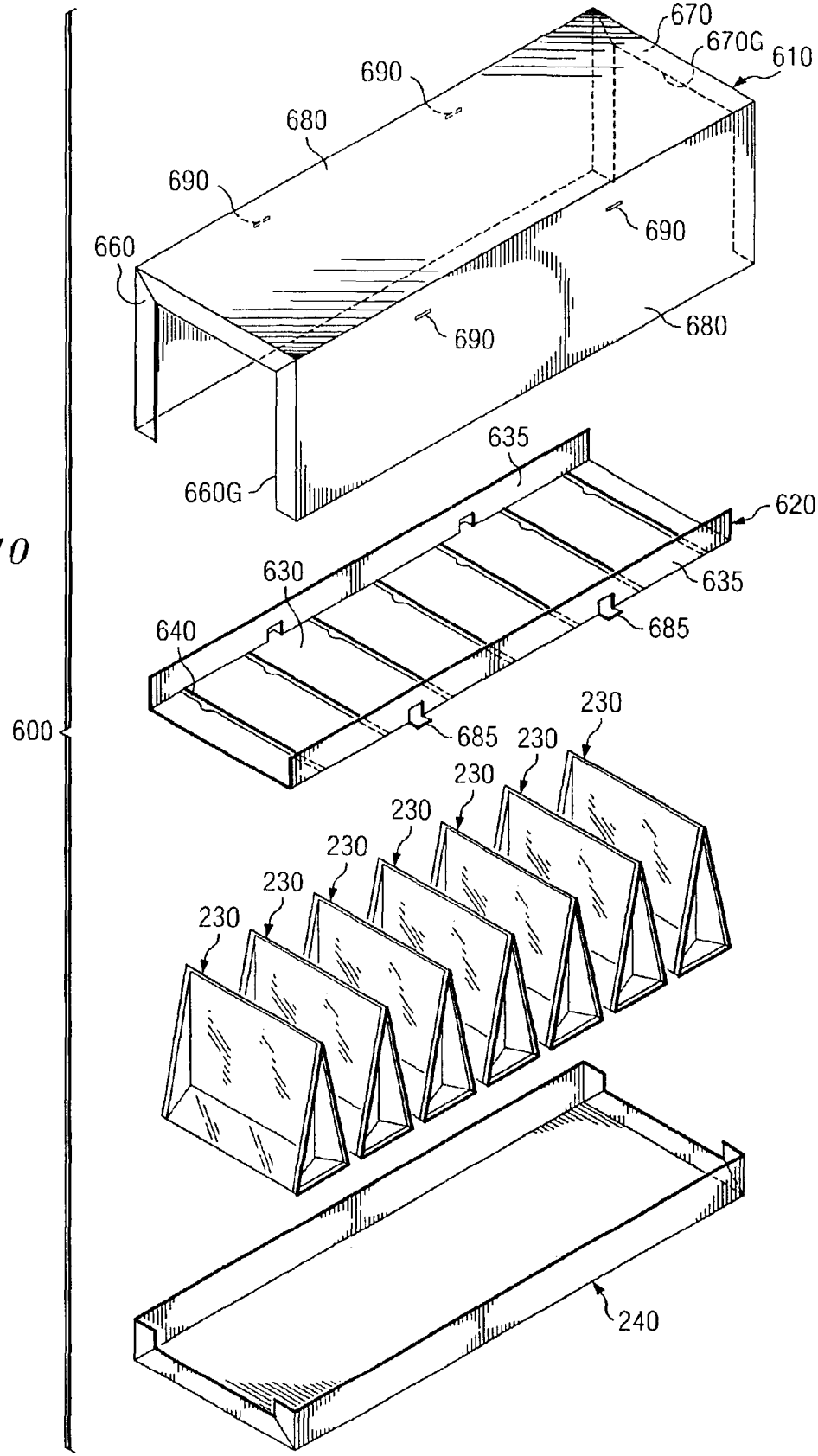
FIG. 10 is an exploded view of a convertible packaging assembly according to a second embodiment of the invention.

FIG. 10 shows an exploded view of the shipping configuration of a packaging assembly 600 pursuant to a second embodiment of the invention. As shown in FIG. 10, the second embodiment includes an alternative shipping shell 610 and shipping liner 620.

The shipping liner 620 of the second embodiment includes a liner surface 630 that extends in a longitudinal direction and defines a plurality of slots 640 that each extend somewhat parallel to a lateral direction. The shipping liner also includes, extending somewhat normal to the liner surface 630 from opposite edges thereof, opposing liner side walls 635. The shipping shell 610 is provided having a generally flat cover surface 650. The shipping shell 610 also has a cover front wall 660 that defines a front cover gap 660G, a cover back wall 670 that defines a back cover gap 670G, and opposite cover side walls 680. The combination of the cover surface 650, the cover front wall 660, the cover back wall 670, and the opposite cover side walls 680 at least partially define a space into which the shipping liner 620 and the plurality of display packs 230 can be packed for shipping.

The shipping liner 620 is configured to line the interior side of the cover side walls 680 and the cover surface 650. The shipping liner 620 has a plurality of outwardly projecting retaining tongues 685 that extend laterally beyond each of the display side walls 635 from the liner surface 630. The cover side walls 680 each include a plurality of retaining holes 690 arranged to be aligned with respective retaining tongues 685 such that, when the shipping liner 620 is properly positioned in the shipping shell 610, each of the plurality of retaining tongues 685 will engage a respective retaining hole 690, resulting in the shipping liner 620 being retained in the shipping shell 610.

Figure 11:
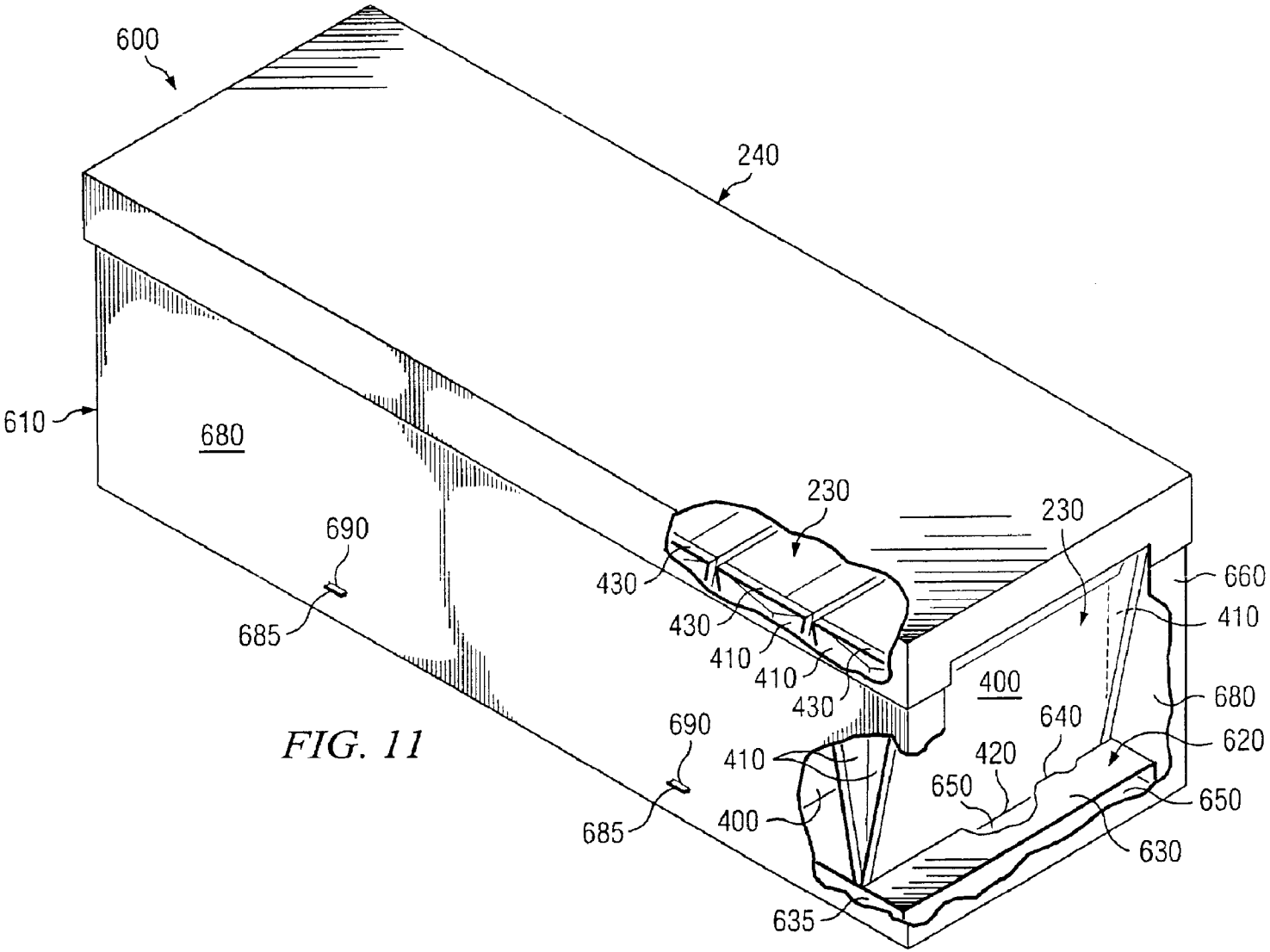
FIG. 11 is a partially broken away perspective view of the convertible packaging assembly shown in FIG. 10 in the shipping configuration.

FIG. 11 shows a partially broken away perspective view of the packaging assembly 600 in the shipping configuration. The broken away portions of the shipping shell 610 and the shipping liner 620 provide a view of one of the display packs 230 seated in a respective one of the slots 630 of the shipping liner 620. As shown in FIG. 11, the ridge 420 of the display pack 230 is seated in the slot 630. The ridge 420 passes through the slot 630 and into a space between the liner surface 630 and the cover surface 650. As a result, the slot 630 wraps around the display pack 230 some distance from the cover surface 630. The distance between the liner surface 630 and the cover surface 650 is maintained due in part to the opposing display side walls 635 that extend between the liner surface 630 and the cover surface 650. Thus, the distance between the liner surface 630 and the cover surface 650 can be varied by varying the height of the display side walls 635. While some distance between the liner surface 630 and the cover surface 650 is preferred, the actual distance can be any distance. It is also contemplated that the height of the display side walls 635 can vary along the length of each of the side walls 635 as well as from one to the other side wall 635, providing variations in the distance between the liner surface 630 and the cover surface 650.

Figure 12B:
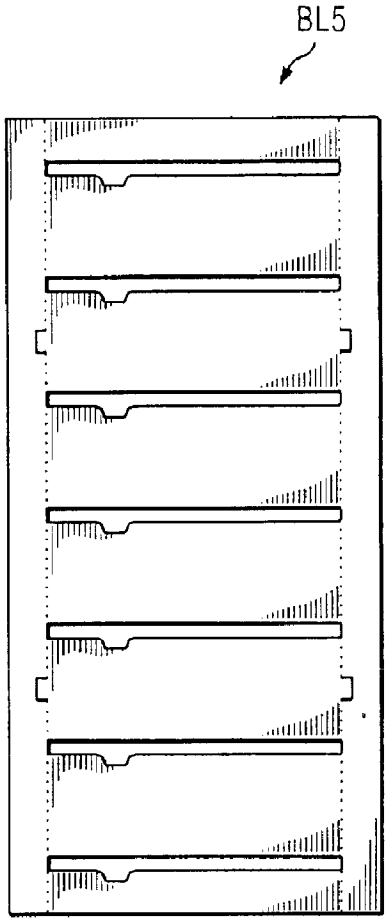
FIGS. 12*a* and 12*b* are plan views of blanks suitable for making the shipping shell and the shipping liner, respectively, according to the second embodiment.
Figure 12A:
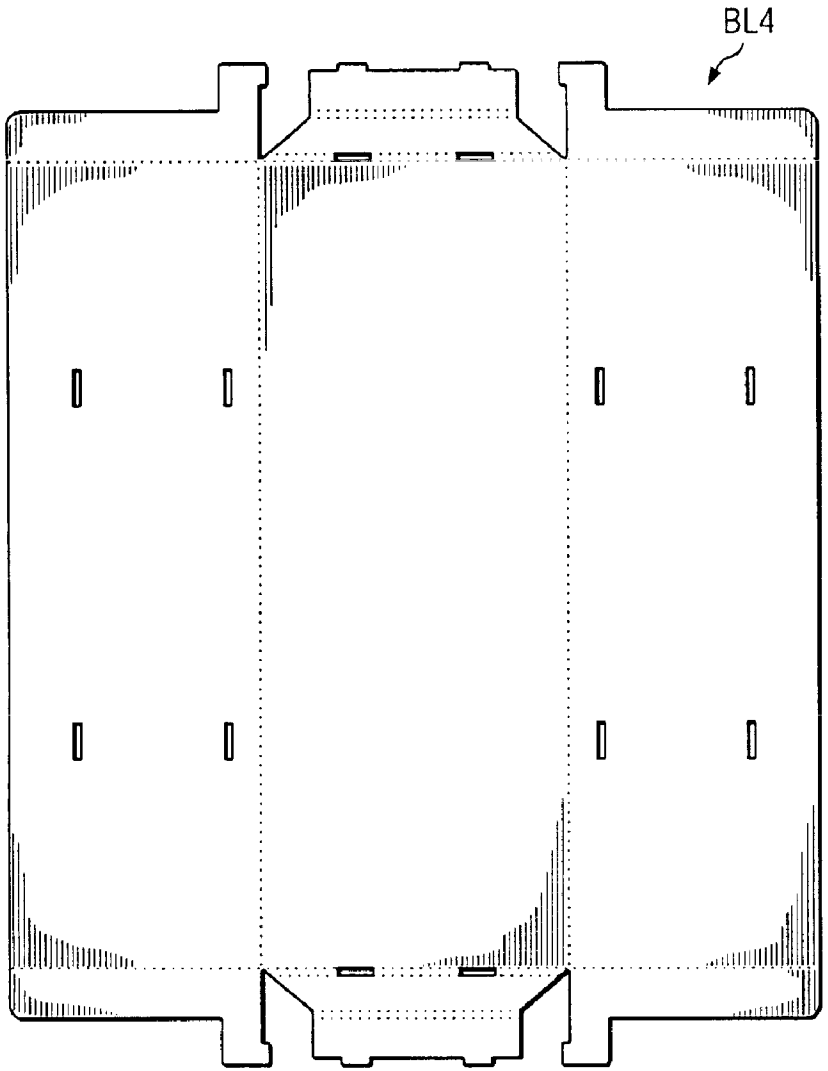

A blank BL4 suitable for making the shipping shell 610 is shown in FIG. 12*a*, and a blank BL5 suitable for making the shipping liner 620 is shown in FIG. 12*b*. In FIGS. 12*a* and 12*b*, the solid lines represent cutting lines and the broken lines represent folding lines. Blanks BL4 and BL5 are each preferably die cut from a respective unitary sheet of material.

Figure 13:
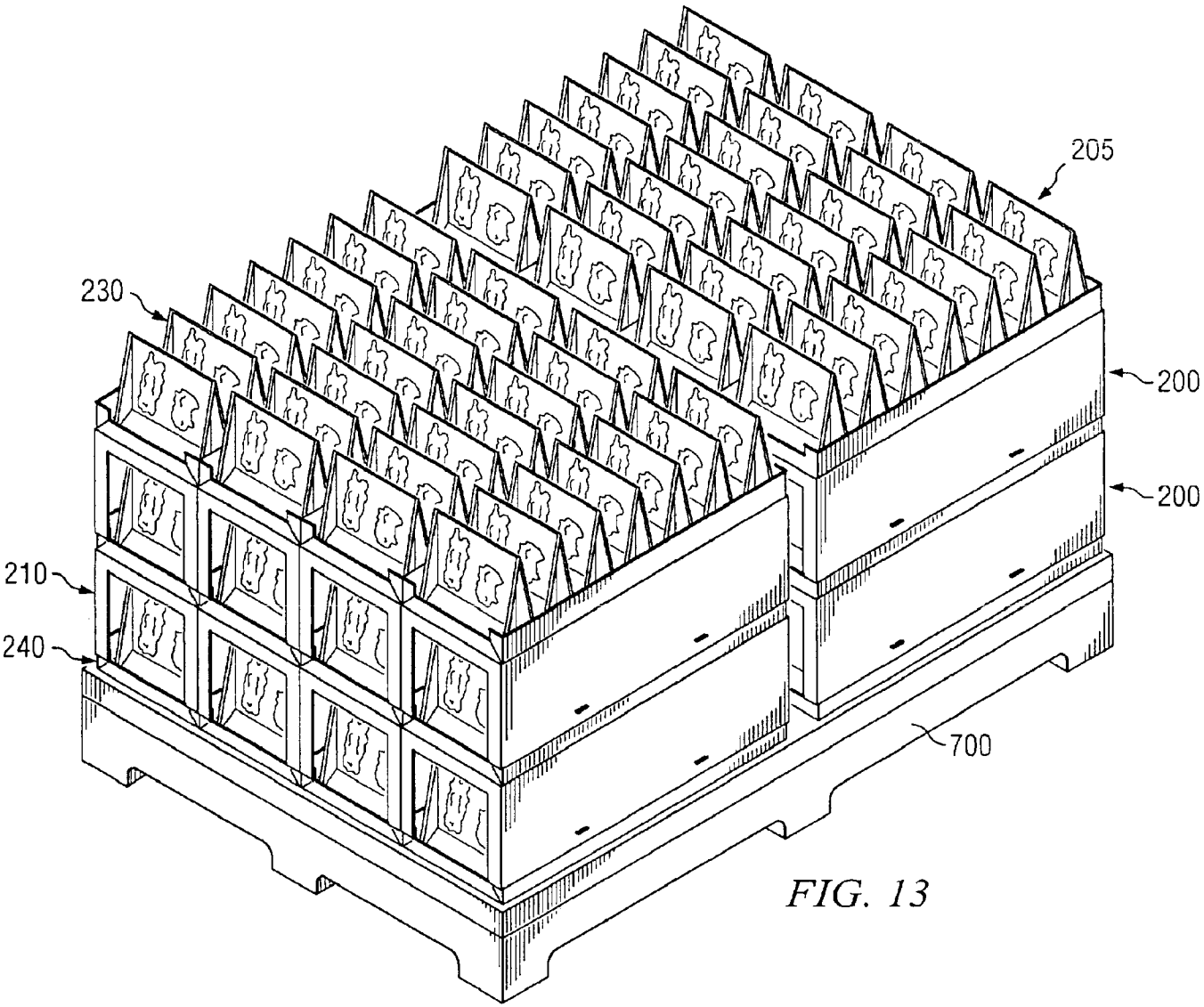
FIG. 13 is a perspective view of a plurality of palletized convertible packaging assemblies.

FIG. 13 shows a perspective view of a plurality of stacked packaging assemblies 200 and display units 205 on a pallet 700. Alternately, the stack, or packaging unit, can also include packaging assemblies 600 mixed among the packaging assemblies 200 or instead of the packaging assemblies 200. The packaging assemblies 200 and/or 600 and display units 205 can be placed in a retail facility as shown in FIG. 13, where the upper-most layer, or packaging layer, is in the displaying configuration and the lower layers remain in shipping configuration. Also, the packaging assemblies 200 and/or 600 can be shipped in a palletized manner similar to that shown in FIG. 13, with the exception that the uppermost layer would be preferably be in shipping configuration rather than in displaying configuration as shown. In order to ease the transition from shipping configuration to displaying configuration, the shipping shells 210 for the top layer, or any layer, can be fixed together in some way, for example using tape or an adhesive of some sort. This way, all of the shipping shells of the top layer can be removed in a single step, thereby converting all of the packaging assemblies 200 and/or 600 of the top layer from the shipping configuration to the displaying configuration in a single step.

It is contemplated that the packaging assemblies 200 and/or 600 and upper layer of display units 205 could be shipped in a palletized manner similar to that shown in FIG. 13, for example, by wrapping the pallet with a suitable shrink-wrap material (not shown) and/or cardboard panels that could be used to hold the top layer of display packs 230 at least somewhat in place.

While endeavoring in the foregoing specification to draw attention to those features of the invention believed to be of particular importance, it should be understood that the Applicant claims protection in respect of any patentable feature, or combination of features, hereinbefore referred to and/or shown in the drawings, whether or not particular emphasis has been placed thereon.

What is claimed is:

1. A packaging assembly for shipping and displaying a plurality of display packs, the packaging assembly comprising:

a base having a base surface and a peripheral base wall around the base surface, said base configured to retain the plurality of display packs on the base surface;

a shipping cover having a cover surface and a peripheral cover wall around the cover surface, the shipping cover being configured to be removably engaged with the base; and a shipping liner that defines a slot for restraining a portion of one of the plurality of display packs, wherein the slot extends in a first direction, wherein the slot restrains a portion of one of the plurality of display packs in a second direction somewhat perpendicular to said first direction, wherein the shipping liner includes two outwardly projecting locking tongues, wherein the cover wall includes a cover back wall, opposite cover side walls, and a cover front wall, and wherein each of the opposite cover side walls includes a slit which is sized and configured to receive therewithin a respective one of said locking tongues, whereby the shipping liner may be retained in the shipping cover.

2. A packaging assembly for shipping and displaying a plurality of display packs, the packaging assembly comprising:

a base having a base surface and a peripheral base wall around the base surface, said base configured to retain the plurality of display packs on the base surface;

a shipping cover having a cover surface and a peripheral cover wall around the cover surface, the shipping cover being configured to be removably engaged with the base; and a shipping liner that defines a slot for restraining a portion of one of the plurality of display packs, wherein the slot extends in a first direction, wherein the slot restrains a portion of one of the plurality of display packs in a second direction somewhat perpendicular to said first direction, wherein the cover wall includes opposite cover side walls, wherein the shipping liner includes opposite liner side walls, each of the liner side walls extending somewhat normal to a liner surface from opposite edges thereof, wherein each of the liner side walls extends interiorly about a respective one of the cover side walls, wherein each of the liner side walls defines a plurality of slots, the plurality of slots including said slot, wherein each of the slots defined by one of the liner side walls corresponds with a respective one of the slots defined by the other liner side wall to form a corresponding pair of slots, wherein each corresponding pair of slots is configured to receive one of the display packs, and wherein portions of the shipping liner adjoining each side of each of said plurality of slots are spaced from the respective cover side wall to define a plurality of retaining gaps, each of said plurality of retaining gaps cooperating with another retaining gap to form a corresponding pair of retaining gaps, and each pair of corresponding retaining gaps cooperating with another pair of corresponding retaining gaps to form a corresponding quadruplet of retaining gaps, wherein each corresponding quadruplet of retaining gaps is configured to receive a flanged portion of one of the display packs.

3. A packaging assembly according to claim 2, wherein each corresponding pair of retaining gaps is associated with a respective one of the plurality of slots, and wherein each corresponding quadruplet of retaining gaps is associated with a respective one of the corresponding pairs of slots.

4. A packaging assembly according to claim 3, wherein each retaining gap of each corresponding quadruplet of retaining gaps is configured to receive therewithin a respective one of four flanged portions extending from a respective one of said display packs.

5. A packaging assembly according to claim 4, wherein the display packs are unrestrained by the slots in said first direction, and wherein the display packs are unrestrained by the gaps in said first direction.

6. A packaging assembly for shipping and displaying a plurality of products, the packaging assembly comprising:

a plurality of display packs, each display pack holding at least one of the plurality of products;

a base having a generally flat base surface and a peripheral base wall around the base surface, said base wall configured to laterally retain the plurality of display racks on the base surface;

a shipping cover having a generally flat cover surface and a peripheral cover wall around the cover surface, said peripheral cover wall being configured to be removably engaged with the base; and a shipping liner having a liner surface that extends in a first direction and in a second direction, the shipping liner defining a plurality of slots, each slot for restraining at least a portion of a respective one of the plurality of display packs in at least one of said first and second directions the shipping liner being removably engaged with the shipping cover, wherein said base wall includes a base back wall, opposite base side walls, and a base front wall, and wherein said peripheral cover wall includes a cover back wall, opposite cover side walls, and a cover front wall, wherein the shipping liner includes opposing liner side walls, each of the liner side walls extending somewhat normal to the liner surface from opposite edges thereof, wherein each of the liner side walls extends interiorly about a respective one of the cover side walls, wherein the liner side walls define the plurality of slots, wherein each of the slots defined by one of the liner side walls corresponds with a respective one of the slots defined by the opposing liner side wall to form a corresponding pair of slots, wherein each corresponding pair of slots is configured to receive one of the display packs, and wherein portions of the liner side walls adjoining each side of each of said plurality of slots are spaced from the respective cover side wall to define a plurality of retaining gaps, each of said plurality of retaining gaps cooperating with another retaining gap to form a corresponding pair of retaining gaps, and each pair of corresponding retaining gaps cooperating with another pair of corresponding retaining gaps to form a corresponding quadruplet of retaining gaps, wherein each corresponding quadruplet of retaining gaps is configured to receive flanged portions of one of the display packs.

7. A packaging assembly according to claim 6, wherein each corresponding pair of retaining gaps is associated with a respective one of the plurality of slots, and wherein each corresponding quadruplet of retaining gaps is associated with a respective one of the corresponding pairs of slots.

8. A packaging assembly according to claim 7, wherein each retaining gap of each corresponding quadruplet of retaining gaps is configured to receive therewithin a respective one of four flanged portions extending from a respective one of said display packs.

9. A packaging assembly according to claim 8, wherein the display packs are unrestrained by the slots in a direction normal to the liner surface, and wherein the display packs are unrestrained by the gaps in the direction normal to the liner surface.

10. A packaging assembly for shipping and displaying a plurality of products, the packaging assembly comprising:

a plurality of display packs, each display pack holding at least one of the plurality of products;

a base having a generally flat base surface and a peripheral base wall around the base surface, said base wall configured to laterally retain the plurality of display packs on the base surface;

a shipping cover having a generally flat cover surface and a peripheral cover wall around the cover surface, said peripheral cover wall being configured to be removably engaged with the base; and a shipping liner having a liner surface that extends in a first direction and in a second direction, the shipping liner defining a plurality of slots, each slot for restraining at least a portion of a respective one of the plurality of display packs in at least one of said first and second directions the shipping liner being removably engaged with the shipping cover, wherein said base wall includes a base back wall, opposite base side walls, and a base front wall, and wherein said peripheral cover wall includes a cover back wall, opposite cover side walls, and a cover front wall, and wherein the shipping liner includes two outwardly projecting locking tongues.

11. A packaging assembly according to claim 10, wherein each of the opposite cover side walls includes a slit which is sized and configured to receive therewithin a respective one of said locking tongues, whereby the shipping liner may be retained in the shipping cover.

12. A packaging unit comprising:

a plurality of packaging layers, wherein at least one of the plurality of packaging layers includes a plurality of packaging assemblies, a first packaging assembly of said plurality of packaging assemblies comprising:

a base having a base surface and a peripheral base wall around the base surface, said base configured to retain a plurality of display packs on the base surface;

a shipping cover having a cover surface and a peripheral cover wall around the cover surface, the shipping cover being configured to be removably engaged with the base; and a shipping liner that defines a slot for restraining a portion of one of the plurality of display packs, wherein the slot extends in a first direction, wherein the slot restrains a portion of one of the plurality of display packs in a second direction somewhat perpendicular to said first direction, wherein the cover wall includes opposite cover side walls, the shipping liner includes opposite liner side walls, each of the liner side walls extends somewhat normal to a liner surface from opposite edges thereof, each of the liner side walls extends interiorly about a respective one of the cover side walls, each of the liner side walls defines a plurality of slots, the plurality of slots including said slot, each of the slots defined by one of the liner side walls corresponds with a respective one of the slots defined by the opposite liner side wall to form a corresponding pair of slots, and each corresponding pair of slots is configured to receive one of the display packs, and wherein, in said first packaging assembly, portions of the shipping liner adjoining each side of each of said plurality of slots are spaced from the respective cover side wall to define a plurality of retaining gaps, each of said plurality of retaining gaps cooperating with another retaining gap to form a corresponding pair of retaining gaps, and each pair of corresponding retaining gaps cooperating with another pair of corresponding retaining gaps to form a corresponding quadruplet of retaining gaps, wherein each corresponding quadruplet of retaining gaps is configured to receive flanged portions of one of the display packs.

13. A packaging unit according to claim 12, wherein, in said first packaging assembly, each corresponding pair of retaining gaps is associated with a respective one of the plurality of slots, and wherein each corresponding quadruplet of retaining gaps is associated with a respective one of the corresponding pairs of slots.

14. A packaging unit according to claim 13, wherein, in said first packaging assembly, each retaining gap of each corresponding quadruplet of retaining gaps is configured to receive therewithin a respective one of four flanged portions extending from a respective one of said display packs.

15. A packaging unit according to claim 14, wherein, in said first packaging assembly, the display packs are unrestrained by the slots in said first direction, and wherein the display packs are unrestrained by the gaps in said first direction.

16. A packaging unit according to claim 15, comprising a second packaging assembly of the plurality of packaging assemblies wherein the liner surface defines said slot.

17. A packaging unit according to claim 16, wherein, in said second packaging assembly, at least a portion of the liner surface is spaced from the cover surface, the liner surface defines a plurality of slots including said slot, and each slot is configured to receive therewithin a portion of a respective one of said display packs.

18. A packaging unit according to claim 17, wherein, in said second packaging assembly, the display packs are unrestrained by the slots in said first direction.

* * * * *

UNITED STATES PATENT AND TRADEMARK OFFICE

CERTIFICATE OF CORRECTION

PATENT NO. : 6,953,118 B2
DATED : October 11, 2005
INVENTOR(S) : Atsuo Seno and Satoru Saito It is certified that error appears in the above-identified patent and that said Letters Patent is hereby corrected as shown below:

Column 10,
Line 60, delete “racks” and insert -- packs --.

Signed and Sealed this

Twenty-seventh Day of December, 2005

JON W. DUDAS
*Director of the United States Patent and Trademark Office*